US005957118A

United States Patent [19]

Tateno et al.

[11] Patent Number: 5,957,118

[45] Date of Patent: Sep. 28, 1999

[54] OIL SEPARATING APPARATUS FOR ENGINE

[75] Inventors: Yoshimitsu Tateno, Oura; Ryoji Kurasawa, Tokyo; Tadashi Sakamaki, Ageo, all of Japan

[73] Assignee: Fuji Jukogyo Kabushiki Kaisha, Tokyo, Japan

[21] Appl. No.: 08/985,111

[22] Filed: Dec. 4, 1997

[30] Foreign Application Priority Data

Dec. 18, 1996 [JP] Japan ..... 8-338434

[51] Int. Cl.[6] ..... F01M 13/00

[52] U.S. Cl. ..... 123/573

[58] Field of Search ..... 123/572, 573, 123/574

[56] References Cited

U.S. PATENT DOCUMENTS 4,459,966 7/1984 Sakano et al. ..... 123/573

4,597,372 7/1986 Furukawa ..... 123/573

4,920,930 5/1990 Sakano et al. ..... 123/573

*Primary Examiner*—Marguerite McMahon

*Attorney, Agent, or Firm*—Martin A. Farber

[57] ABSTRACT

An oil separating apparatus of an engine mounted on a shaking machine such as a rammer, for separating oil mist from blow-by gas and for feeding liquefied oil back to a crank chamber comprises a rocker chamber having an enlarged volume and mounted on a cylinder head, a breather chamber mounted on the rocker chamber, a blow-by gas port provided on the locker chamber for communicating the rocker chamber with the breather chamber, and an oil passage having an enlarged passage area for communicating the crank chamber with the rocker chamber. The constituted oil separating apparatus separates oil mist from blow-by gas almost completely and returns liquefied oil to the crank chamber swiftly, even when the engine produces a large amount of oil mist due to violent vibrations of the shaking machine.

11 Claims, 3 Drawing Sheets

OIL SEPARATING APPARATUS FOR ENGINE

BACKGROUND OF THE INVENTION

1. Field of the invention

The present invention relates to an oil separating apparatus for an engine, particularly an engine used for a shaking machine such as a rammer.

2. Prior Art

Generally, there is an engine whose valve mechanism is lubricated by splashed oil, i.e., oil mist mixed with blow-by gas or oil in droplets splashed by a crank. In this type of engine, it is important to maintain a constant flow of blow-by gas within the rocker chamber and for that purpose this type of engine has an oil separating apparatus connected with the air intake system of the engine through a breather hose. In the oil separating apparatus, oil is separated from blow-by gas. Blow-by gas is sucked into the air intake system to be burned in the combustion chamber and oil is used for lubricating the valve mechanism.

In the prior art, this oil separating apparatus is accomplished by forming a breather chamber on the side wall of the cylinder block.

However, in order to complete the oil separation in the breather chamber, the breather chamber needs miscellaneous complicated techniques such as providing an oil shelter, changing the shape of the breather chamber variously, enlarging the volume of the breather chamber and the like.

Hence, many techniques have been proposed to raise oil separating efficiency of the breather chamber and to simplify its construction. For example, Japanese Published Utility Model Application No. Jitsu-Kou-Hei 6-6177 invented by the inventor of the present invention discloses an oil separating apparatus comprising an intake push rod chamber, an exhaust push rod chamber communicated with the intake push rod chamber through a rocker chamber, a breather passage communicated with one push rod chamber. The oil separating apparatus further comprises a breather port provided on the side wall of the other push rod chamber for communicating with a breather chamber and an oil separating device communicating both push rod chambers with the crank chamber through an oil return hole having a small diameter for repeating oil separation before blow-by gas enters the breather chamber.

In applying this technique to an engine for a shaking machine such as a rammer, since a significant amount of oil flows into the rocker chamber due to violent vibrations of the shaking machine, there is a possibility that the oil pan lacks oil and as a result sliding components of the engine have a lack of lubrication.

Further, the significant amount of oil flowing into the rocker chamber chokes passages and makes it difficult to process blow-by gas flow.

Further, in order to separate oil adequately from the blow-by gas containing a large amount of oil mist, a significantly large size of the breather chamber would be needed, exceeding a practicable level of size.

SUMMARY OF THE INVENTION

It is therefore an object of the present invention to provide an oil separating apparatus capable of adequately separating oil from blow-by gas and swiftly feeding oil back to the crank chamber without accumulating oil in the rocker chamber.

To attain the object, the oil separating apparatus comprises:

a rocker chamber having an enlarged volume and mounted on the cylinder head;

a breather chamber mounted on the rocker chamber;

a blow-by gas port provided on the rocker chamber for communicating the rocker chamber with the breather chamber; and an oil passage having an enlarged passage area for communicating the crank chamber with the rocker chamber.

DETAILED DESCRIPTION OF THE INVENTION

Figure 1:
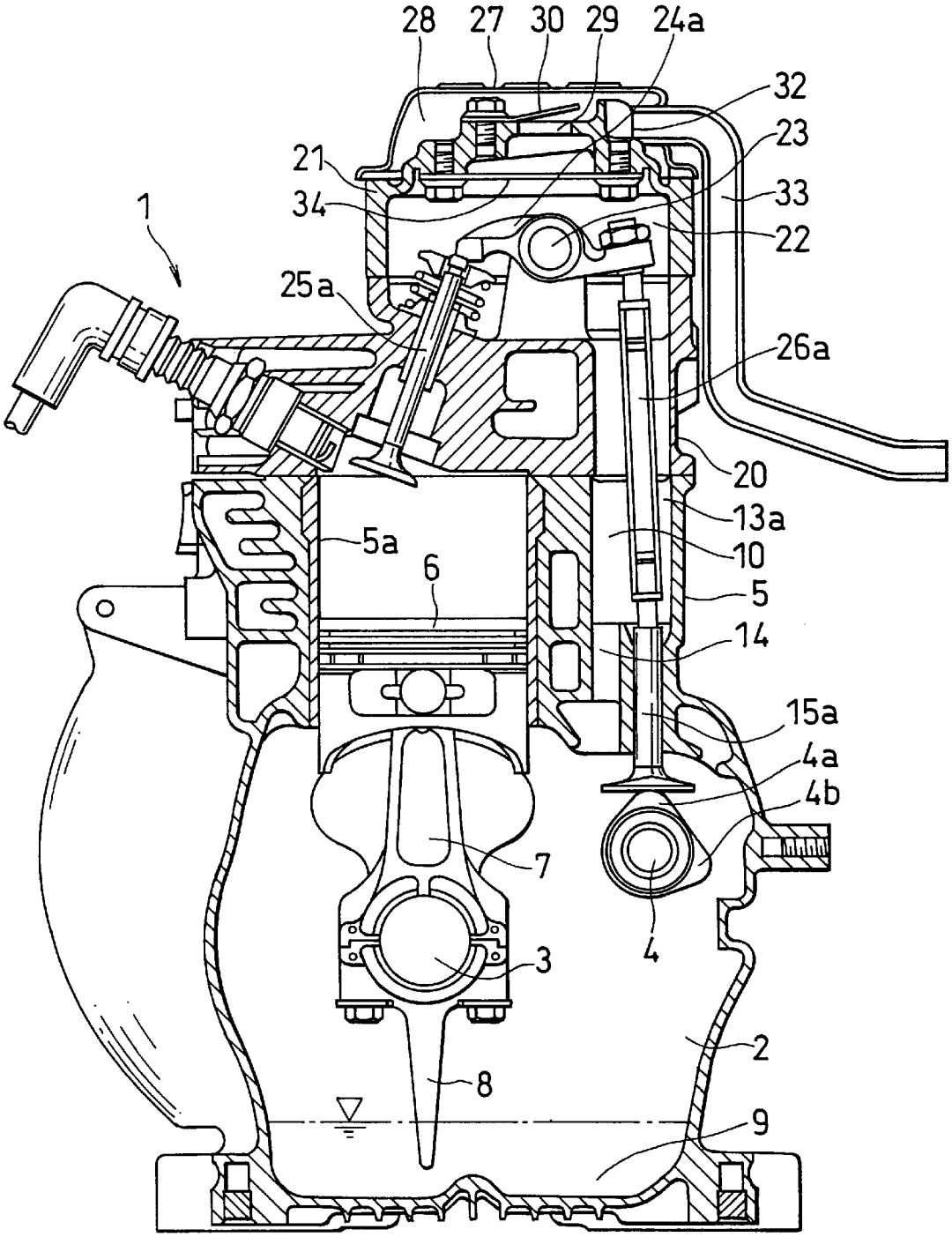
FIG. 1 is a cross sectional view of an engine having an oil separating apparatus according to the present invention.
Figure 2:
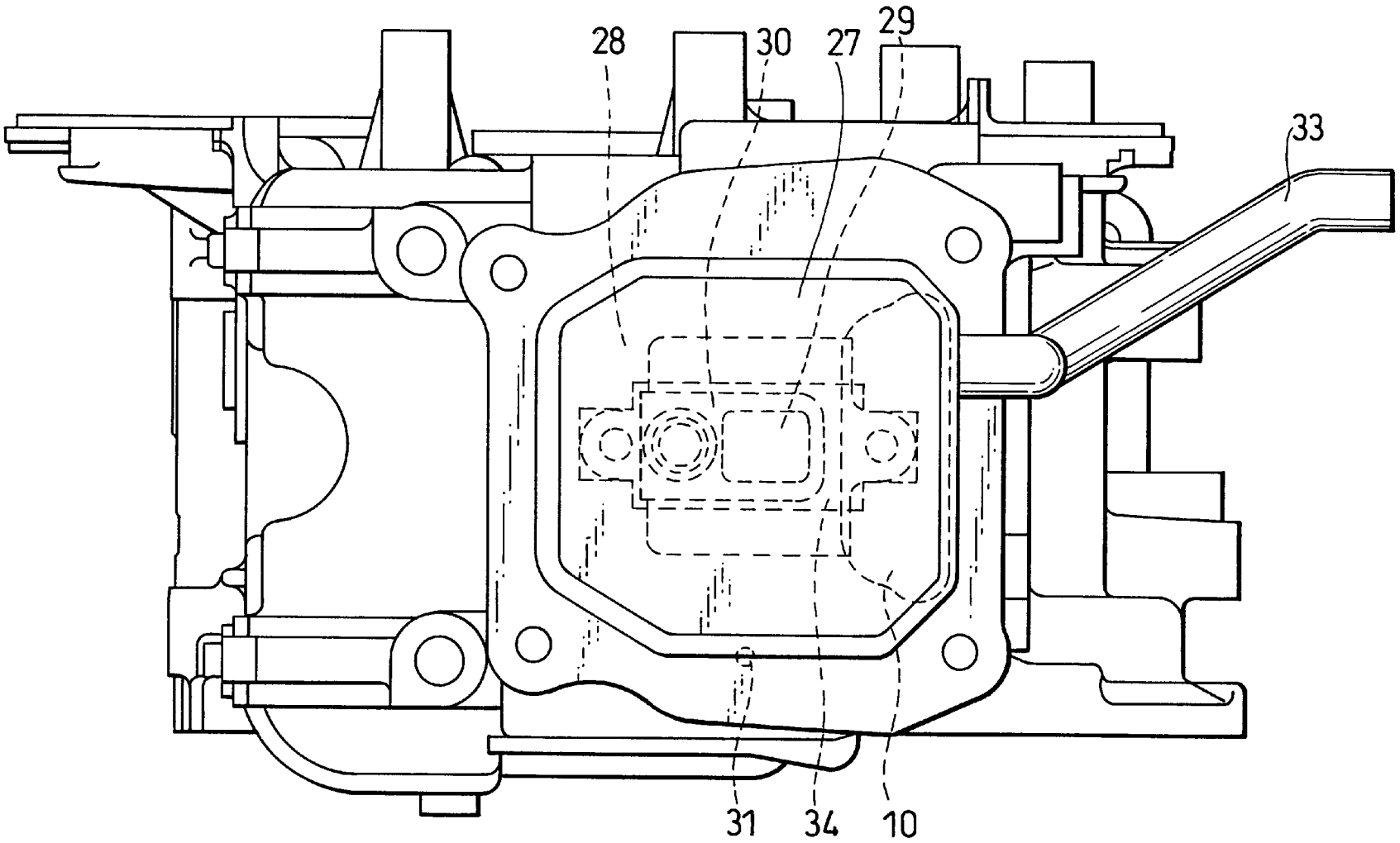
FIG. 2 is a top view of the engine shown in FIG. 1.

Referring now to FIG. 1, numeral 1 denotes an engine to be mounted on a shaking machine and numeral 2 denotes a crank chamber. In the crank chamber 2, there are provided a crank shaft 3 and a cam shaft 4.

Numeral 5 denotes a cylinder block 5 in which a cylinder liner 5*a,* and a piston 6 are disposed. Further, a connecting rod 7 is mounted on the crank shaft 3.

Further, numeral 8 denotes an oil-dipper which is connected with the bearing cap of the connecting rod 7. The oil-dipper 8 is for splashing oil with each rotation of the crank shaft so as to lubricate the cylinder liner 5*a,* the crank shaft 3, the cam shaft 4, the balancer shaft (not shown) and other sliding parts.

Further, there is provided a cylinder head 20 on the top surface of the cylinder block 5. Further, there is provided rocker chamber 22 covered by a locker cover 21 on the top of the cylinder head 20.

In this invention, the rocker chamber 22 is utilized for an oil separating chamber as well as for accommodating the valve rocker mechanism. The locker chamber 22 has a volume (for example 700 cc and more) enough to separate blow-by gas from oil mist.

Further, there is vertically provided an oil passage 10 for communicating the crank chamber 2 with the rocker chamber 22 through the cylinder block 5 and the cylinder head 20.

Figure 3:
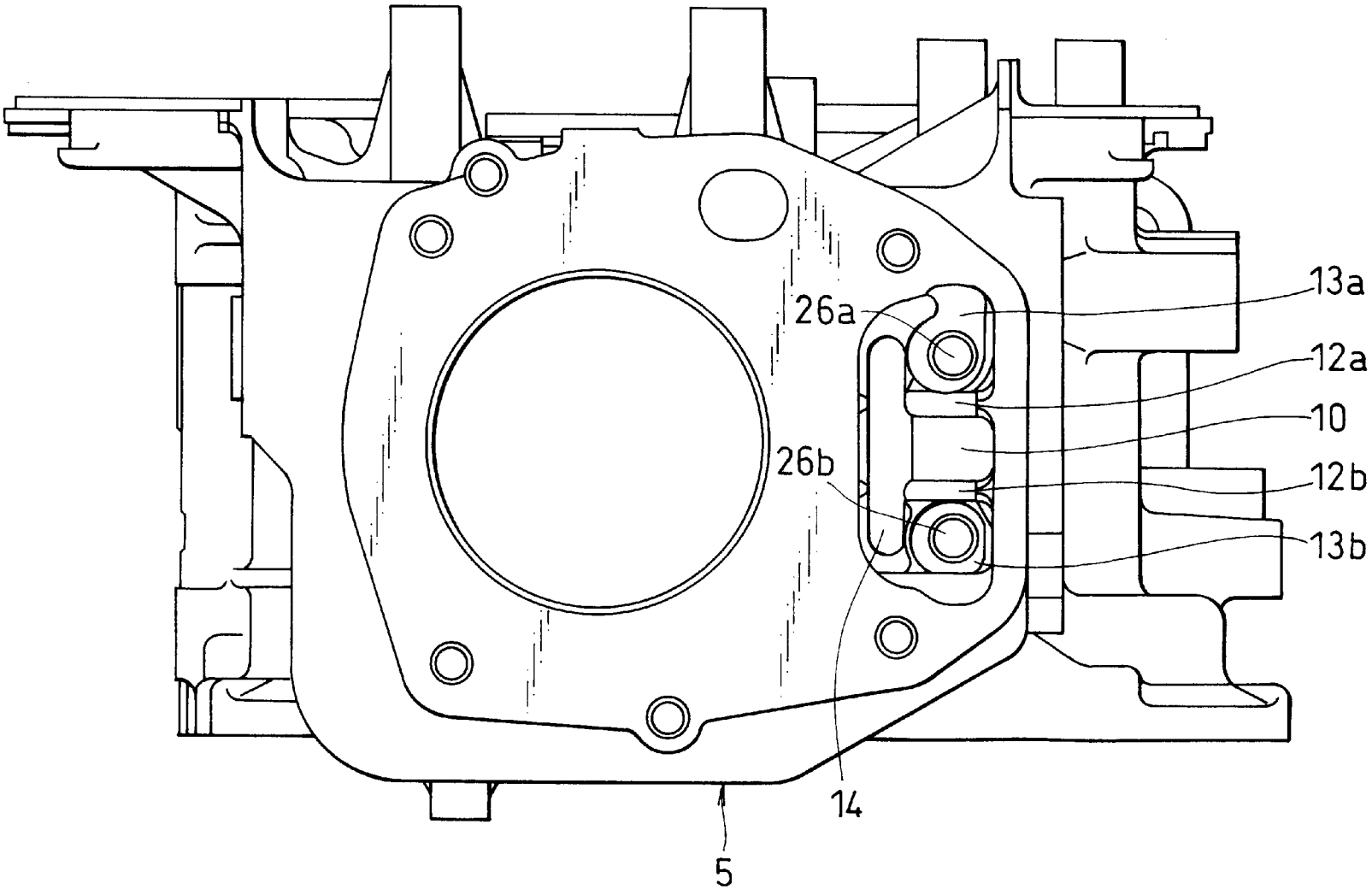
FIG. 3 is a top view of a cylinder block of the engine shown in FIG. 1.

Further, as shown in FIG. 3, there is provided a slot-shaped oil restriction hole 14 which is open to the crank chamber 2 at the lower end of the oil passage 10. In case of an ordinary engine, this oil restriction hole 14 is literally for restricting the rising oil and therefore the area of the oil restriction hole should be as small as possible. However, in this case of the engine used for the shaking machine, the area is established to be relatively large, for example more than 200 square millimeters.

Further, an intake push rod chamber 13*a* is formed by the wall surface of the oil passage 10 and a rib 12*a* which is provided in the oil passage 10. Similarly, an exhaust push rod chamber 13*b* is formed by the wall surface of the oil passage 10 and a rib 12*b* which is provided in the oil passage 10.

Further, an intake push rod 26*a* and an exhaust push rod 26*b* are vertically inserted into the intake push rod chamber 13*a* and the exhaust push rod chamber 13*b,* respectively. Further, the intake push rod 26*a* and the exhaust push rod

26*b* are contacted at the lower end thereof by an intake tappet 15*a* and an exhaust tappet (not shown), respectively. The intake tappet 15*a* and the exhaust tappet (not shown) are contacted at the lower end thereof by an intake cam 4*a* and an exhaust cam 4*b,* respectively. Further, the upper ends of the intake push rod 26*a* and the exhaust push rod 26*b* project into the rocker chamber 22.

In the rocker chamber 22, an intake locker 24*a* and an exhaust rocker (not shown) are supported by a locker shaft 23, respectively. The intake rocker 24*a* and the exhaust locker 24*b* are contacted at the base portion thereof by the push rods 26*a,* 26*b* respectively and are contacted at the tip portion thereof by stem ends of an intake valve 25*a* and an exhaust valve (not shown), respectively.

A breather chamber 28 is formed by mounting a breather cover 27 on the top surface of the rocker cover 21.

Further, there is provided a blow-by gas passage 29 for communicating the rocker chamber 22 with the breather chamber 28 on the top surface of the rocker cover 21. Further, there is provided an oil shield plate 34 on the rocker chamber 22 side of the blow-by gas passage 29. On the other hand, there is provided a reed valve 30 for opening and closing the blow-by gas passage 29 on the breather chamber 28 side of the blow-by gas passage 29.

Further, there is provided an oil return hole 31 for returning the oil liquefied in the breather chamber 28 to the rocker chamber 22 on the top surface of the locker cover 21.

Further, the breather cover 27 has a discharge port 32 for discharging blow-by gas to an air intake system through a breather pipe 33 and an air cleaner (not shown).

Describing an operation of the embodiment thus constituted, when the engine starts, the oil-dipper 8 throws up oil in the oil pan 9 as droplets or mist to surrounding components of the engine. On the other hand, violent vertical vibrations of the shaking machine produce a large amount of oil mist and the crank chamber 2 is filled with the oil mist.

The oil in droplets and the oil in mist lubricate the cylinder liner 5*a,* the crank shaft 3, the cam shaft 4, the balancer shaft (not shown) and other sliding parts.

On the other hand, blow-by gas generated at each combustion stroke is mixed with oil mist in the crank chamber 2 and the mixture gas is discharged out of the crank chamber 2 through the restriction hole 14, and the oil passage 10.

A part of the oil mist sticks to the wall surfaces of the oil passage 10, the push rod chambers 13*a,* 13*b* and the push rods 26*a,* 26*b* and is liquefied thereon. The liquefied oil returns to the crank chamber 2 through the oil passage 10.

On the other hand, the oil mist not liquefied is guided to the rocker chamber 22 together with blow-by gas.

In the rocker chamber 22, due to the pulsation effect of the blow-by gas, the mixture gas of blow-by gas and oil mist repeats collisions between themselves or collisions against the inner wall of the rocker chamber 22 and most of the oil mist is changed into liquid oil. As a result, only the blow-by gas practically not including oil mist, flows around the oil shield plate 34 and reaches the breather chamber 28 through the blow-by gas passage 29.

The liquefied oil in the rocker chamber 22 lubricates the locker shaft 23, the rocker arm 24, the intake valve 25*a,* the exhaust valve, the push rods 26*a,* 26*b* and other sliding parts and then returns to the crank chamber 2 through the oil passage 10.

On the other hand, the blow-by gas flowing into the breather chamber 28 repeats collisions against the inner wall of the breather cover 27, and a very small quantity of the residual oil is liquefied on the inner wall. Thus, the blow-by gas is almost completely separated from the oil mist and is guided to the air intake system through the discharge port 32, the breather pipe 33 and the air cleaner.

The liquefied oil in the breather chamber 28 swiftly returns to the crank chamber 2 through the oil return hole 31, the rocker chamber 22 and the oil passage 10.

Thus, according to the embodiment, since the rocker chamber has an adequate capability of separating oil from blow-by gas and in addition to this the breather chamber 28 is provided on the rocker chamber 22, even if a large quantity of oil mist enters the rocker chamber 22, most of the oil mist is liquefied within the rocker chamber 22 before reaching the breather chamber 28. Further, the small quantity of the residual oil mist is almost completely removed in the breather chamber 28.

Further, since the oil passage 10 and the oil restriction hole are formed so as to have a large passage area, this passage and hole can be prevented from being choked by rising oil, and therefore a constant flow of blow-by gas can be maintained. Further, thus the enlarged oil passage 10 and oil restriction hole are very effective in returning oil swiftly to the crank chamber 2.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. An oil separating apparatus of an engine having a cylinder head, a cylinder block with a cylinder, a piston in said cylinder, a crank chamber having oil therein, and an air intake system, the oil separating apparatus for separating the oil from blow-by gas and for returning said oil to said crank chamber comprising:

a rocker chamber having an enlarged volume and mounted on said cylinder head;

a breather chamber mounted on said rocker chamber and connected to the air intake system of the engine;

a blow-by gas port provided on said rocker chamber communicating said rocker chamber with said breather chamber; and an oil passage having an enlarged free passage area for communicating said crank chamber with said rocker chamber.

2. The oil separating apparatus according to claim 1, further comprising:

a shield plate provided beneath said blow-by gas port.

3. An oil separating apparatus of an engine having a cylinder head, a piston, a cylinder, a crank chamber and an air intake system for separating oil from blow-by gas and for returning said oil to said crank chamber, comprising:

a rocker chamber having an enlarged volume and mounted on said cylinder head;

a breather chamber mounted on said rocker chamber;

a blow-by gas port provided on said rocker chamber for communicating said rocker chamber with said breather chamber;

an oil passage having an enlarged passage area for communicating said crank chamber with said rocker chamber; and a reed valve provided on said blow-by gas port for opening and closing said blow-by gas port.

4. The oil separating apparatus according to claim 1, further comprising:

a discharge port provided in said breather chamber for discharging said blow-by gas to said air intake system.

5. An oil separating apparatus of an engine having a cylinder head containing an intake valve and an exhaust valve, a cylinder provided in a cylinder block thereunder for inserting a piston in a cylinder liner of the cylinder, push rods with tappets in the cylinder head and block, and a crank chamber including a crank shaft and a cam shaft having cams engaging the tappets, being lubricated by splashing lubrication oil in an oil pan in the crank chamber with an oil dipper connected to a lower portion of a connecting rod mounted on the crank shaft, comprising:

a rocker chamber mounted on said cylinder head and containing a rocker arm supported by a rocker shaft operatively connected to said intake and exhaust valves and said push rods for opening and closing said intake and exhaust valves at a required timing by being pushed by cams the push rods via the tappets and the cams;

a breather chamber mounted on said rocker chamber for breathing of said engine via a blow-by gas discharge port;

a blow-by gas port interposed between said rocker chamber and said breather chamber communicating said rocker and breather chambers for upward flow of a mixture of burnt blow-by gases and said oil; and the cylinder block and head being formed with a wide oil passage with a relatively narrow oil restricting throttle at an end of the oil passage communicating with said crank chamber, the oil passage having an enlarged widened passage area communicating said crank chamber with said rocker chamber, the widened passage area effectively returning only a liquid portion of said mixture of gases and oil to said crank chamber by separating the liquid portion from said mixture in said enlarged widened passage area, so that substantially only said burnt blow-by gases flow up through said wide oil passage to said breather chamber, so as to constantly keep a sufficient volume of said oil in said oil pan for lubrication without discharging oil from said breather chamber with said blow-by gases.

6. The oil separating apparatus according to claim 5, further comprising a reed valve provided on said blow-by gas port for opening and closing said blow-by gas port.

7. The oil separating apparatus according to claim 1, wherein said oil passage further encompasses a push rod chamber defined by a wall surface of said oil passage and a rib disposed in said oil passage, a push rod disposed in said push rod chamber and operatively extending into said rocker chamber, and wherein said enlarged free passage area extends laterally beyond said push rod chamber.

8. The oil separating apparatus according to claim 1, wherein said oil passage extends through said cylinder block and cylinder head.

9. The oil separating apparatus according to claim 1, wherein said enlarged free passage area is connected directly to said rocker chamber via a relatively narrow oil restriction hole at a bottom of said oil passage.

10. The oil separating apparatus according to claim 9, wherein said enlarged free passage area extends through said cylinder block and cylinder head to said rocker chamber.

11. The oil separating apparatus according to claim 2, wherein the shield plate has a shape with portions spaced from a wall of said rocker chamber such that said blow-by gases flow around said shield plate into said blow-by gas port.

* * * * *